United States Patent [19]

Ball

[11] 4,303,136

[45] Dec. 1, 1981

[54] FLUID PASSAGE FORMED BY DIAMOND INSERT STUDS FOR DRAG BITS

[75] Inventor: Harry N. Ball, Long Beach, Calif.

[73] Assignee: Smith International, Inc., Newport Beach, Calif.

[21] Appl. No.: 36,215

[22] Filed: May 4, 1979

[51] Int. Cl.[3] ..... E21B 10/56; E21B 10/60

[52] U.S. Cl. ..... 175/329; 175/393; 175/410

[58] Field of Search ..... 175/329, 330, 339, 340, 175/393, 410, 415, 418

[56] References Cited

U.S. PATENT DOCUMENTS

| | | | |
|---|---|---|---|
| 1,388,490 | 8/1921 | Suman | 175/393 X |
| 1,476,481 | 12/1923 | Bashara | 175/421 |
| 2,003,144 | 5/1935 | Graham, Jr. | 175/418 X |
| 2,053,801 | 9/1936 | Mitchell | 175/387 X |
| 3,180,440 | 4/1965 | Birdwell | 175/410 |
| 3,555,937 | 1/1971 | Nicodemas | 175/329 X |
| 4,006,788 | 2/1977 | Garner | 175/330 |
| 4,109,737 | 8/1978 | Bovenkerk | 175/410 X |
| 4,116,289 | 9/1978 | Feenstra | 175/410 X |

FOREIGN PATENT DOCUMENTS

| | | | |
|---|---|---|---|
| 36913 | 9/1970 | Australia | 175/329 |

*Primary Examiner*—James A. Leppink
*Attorney, Agent, or Firm*—Robert G. Upton

[57] ABSTRACT

Diamond drag bits with a multiplicity of individual diamond insert studs standing-off from the face of the bit require fluid over and around each separate insert to cool and clean the stud. An axially aligned fluid passage formed within the insert stud communicates with a fluid-filled chamber formed by the drag bit. The fluid exits the passage in the stud in front of the diamond cutting face of the stud to assure cooling and cleaning of each insert stud inserted in the face of the drag bit.

1 Claim, 4 Drawing Figures

FLUID PASSAGE FORMED BY DIAMOND INSERT STUDS FOR DRAG BITS

BACKGROUND OF THE INVENTION

1. Field of the Invention

This invention relates to diamond drag bits.

More particularly, this invention relates to a means to cool and clean each diamond insert stud standing-off from the face of a diamond drag bit.

2. Description of the Prior Art

Conventional synthetic diamond composite blanks typically are cemented, brazed, or sintered to an insert stud. The diamond layer is generally composed of a polycrystalline material joined to a substrate layer of tungsten carbide material. A synthetic diamond blank of the above description is, for example, manufactured by the Specialty Material Department of General Electric Company of Worthington, Ohio. The foregoing synthetic diamond composite blanks go by the trademark name of Stratapax drill blanks. The Stratapax blanks are generally brazed to the insert stud bodies, the face of the blanks being aligned about 20° with respect to the axis of the body of the stud insert. The studs are typically strategically placed within the face of the diamond drag bits to optimize the cutting action of the drag bit as it is advanced in a borehole. A series of channels or hydraulic passages are generally formed in the drag bit face to provide hydraulic fluid or "mud" to cool and clean each of the studs mounted within the face of the drag bit. These hydraulic channels and passages may be plugged by the cuttings in the bottom of the borehole. For example, the drag bit may gum up when passing through softer formations, thus plugging some of the hydraulic passages in the bit face. If this happens, the individual studs mounted in the drag bit are ineffective and may become overheated and damaged due to lack of cooling.

By providing hydraulic passages in each stud body, each insert stud then has its own supply of hydraulic mud to cool and clean each insert. The hydraulic passage exits each stud in front of the synthetic diamond cutting face of the insert to assure a supply of mud to cool the cutting face of the insert. By providing hydraulic passages in each of the stud bodies, rather than providing separate hydraulic passages in the face of the drag bit body, the drag bit body then is much stronger. This is true because the interference fit holes formed in the face of the drag bits also include the hydraulic passages to cool the bit. A fluid communication link between the hydraulic chamber formed by the drag bit body and the passage formed in each of the stud inserts is thus maintained without the need for separate hydraulic passages or nozzles in the drag bit. The drilling operation wherein the interference fit stud holes are drilled can now be a two-step operation. In the first step, the interference hole is drilled. Secondly, the hydraulic passage is drilled between the bottom of the interference hole and the mud chamber formed by the bit body, this passage being so positioned to align with the passage in the stud. The fabrication process then is much simpler in that both holes are formed by the drag bit in close proximity, one from the other. The drag bit body then is much stronger and tougher since it is not penetrated by a multiplicity of hydraulic passages.

This invention eliminates the need for multiple hydraulic passages in the face of a synthetic diamond drag bit by providing hydraulic passages within the same interference fit hole that the studs are fitted within, each of the studs having hydraulic passages formed therein.

SUMMARY OF THE INVENTION

An object of this invention is to provide a more efficient means to cool and clean individual man-made diamond insert studs for diamond drag bits.

More particularly, it is an object of this invention to provide man-made diamond insert studs having axially aligned hydraulic passages formed by the body of the insert stud to provide cooling and cleaning of the extended cutting end of the stud.

It is a further object of this invention to provide a man-made diamond insert stud with a substantially flat surface transverse to the axis of the insert stud and substantially aligned with the top of the grip length of the body of the stud. The flat surface serves to provide a datum and shoulder surface to facilitate insertion of the stud into an interference fit hole in the face of a diamond drag bit.

The diamond insert stud of the present invention consists of a substantially cylindrical stud body having a first extended diamond cutter end and a second base end with a fluid passageway formed within the body of the stud. The fluid passage is substantially aligned with the axis of the body, the passage further communicates with a fluid chamber formed by the body of the drag bit. An exit end of the passageway is substantially aligned to direct fluid from the chamber of the bit over and around the first diamond cutting end of the stud.

A substantially flat datum surface is formed in the stud body, the surface being transverse to the axis of the stud body. The flat surface is located substantially at an end of a grip length formed by the second end of the stud. The passageway exits in the flat datum surface. The surface additionally serves as a pressure point to install the stud in an interference fit hole formed in the face of a drag bit. A substantially cylindrical solid rod chucked into an arbor of, for example, a hydraulic press is mated with the flat surface of the stud and the hydraulic press then drives the grip length of the base end of the stud into the interference fit hole of the drag bit without damage to the synthetic diamond cutting tip of the stud.

In addition, the exit end of the passageway formed in the stud body is flared to diffuse the fluid exiting the passageway to more effectively direct hydraulic mud over and around the synthetic diamond cutting end of the stand-off portion of the stud body.

An advantage then over state of the art synthetic diamond insert studs is the fluid passageway formed within the body of the stud to assure fluid over and around the extended cutting end of the insert to cool and clean the insert.

Yet another advantage over prior art synthetic diamond drag bits is the lack of a multiplicity of fluid passageways, nozzles, and channels in the face of a drag bit, thus maintaining the integrity and strength of the drag bit body. By incorporating the fluid passageways within the interference fit holes formed in the face of the drag bit, the necessity for additional hydraulic passages in the face of the drag bit is minimized. The use of the stud of the present invention does not exclude the use of standard nozzles or passages where it may be necessary to increase flow through the bit.

The above noted objects and advantages of the present invention will be more fully understood upon a study of the following detailed description in conjunction with the detailed drawings.

FIG. 1 is a partially broken-away perspective view of a synthetic diamond drag bit having a multiplicity of diamond insert studs inserted in the face of the drag bit, FIG. 2 is a partially broken-away side view of a diamond stud insert of the preferred invention inserted in the face of a diamond drag bit, FIG. 3 is a top view of the diamond insert stud illustrated in FIG. 2, and FIG. 4 is a partially broken-away side view of an alternative embodiment of a synthetic diamond insert stud illustrating the fluid passageway at a slight angle with respect to the axis of the stud.

DESCRIPTION OF THE PREFERRED EMBODIMENTS AND BEST MODE FOR CARRYING OUT THE INVENTION

Figure 1:
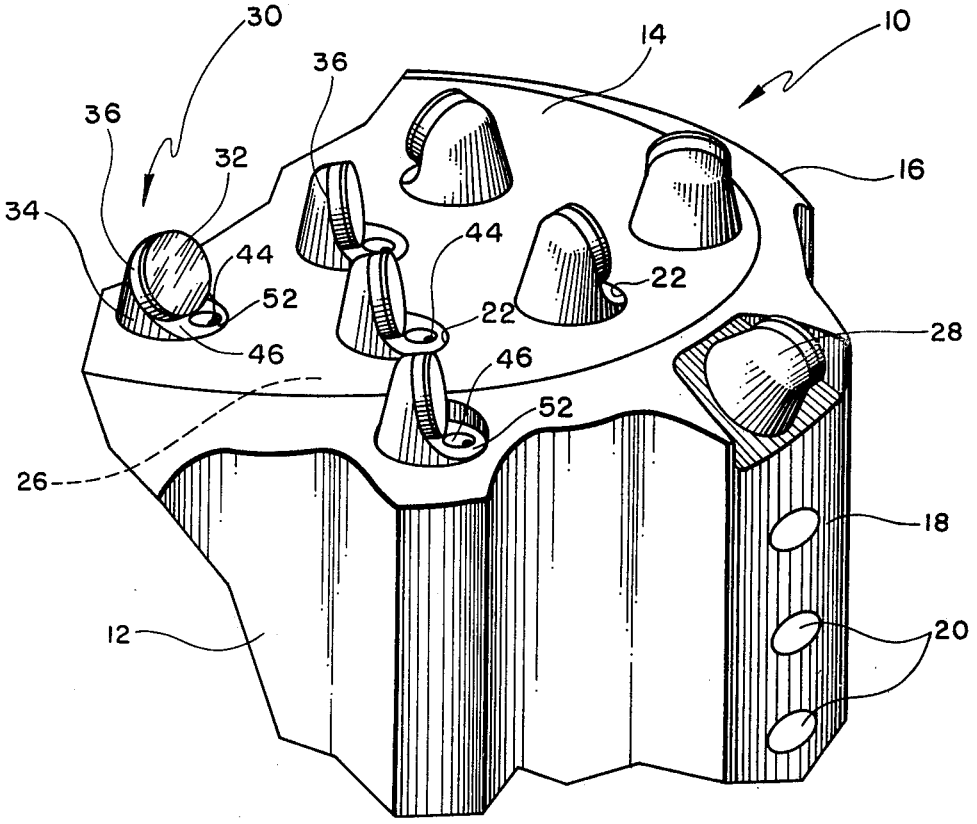

With reference to FIG. 1, the synthetic diamond drag bit, generally designated as 10, consists of a drag bit body 12 which defines face 14. The drag bit further includes stabilizer bosses 18 axially aligned with the center line of the bit. A series of tungsten carbide flush type inserts are imbedded in the peripheral wall of the boss 18. A series of synthetic diamond gage row studs 28 are positioned around the peripheral edge 16 of bit 12. The gage row studs maintain the gage of the borehole as the drag bit 10 is advanced in the borehole. Several synthetic diamond studs, generally designated as 30, are strategically positioned within the face 14 of the bit 12 to assure maximum penetration of the drag bit as it is advanced in the borehole. Each stud 30 is pressed into interference fit holes 22 formed in the face 14 of the drag bit body 12. The stand-off or extended stud portion 34 of stud 30 provides a support surface for the Stratapax composite blank 32. The blank 32 is, for example, brazed or otherwise attached to the tungsten carbide stud body at bonding surface 36.

An axially aligned passageway 42 (FIGS. 1 and 2) communicates at inlet end 48 with an aligned hydraulic passageway 43 in drag bit body 12. Passageway 43 communicates with a hydraulic mud chamber 26 within bit body 12 (not shown). The inlet end 48 of passage 42 is enlarged at point 49 to match the hydraulic passage 43 in bit body 12. The exit end 44 is preferably flared at point 46 to diffuse hydraulic mud as it exits exit 44 thereby assuring adequate mud across the face of the synthetic diamond composite 32.

Figure 2:
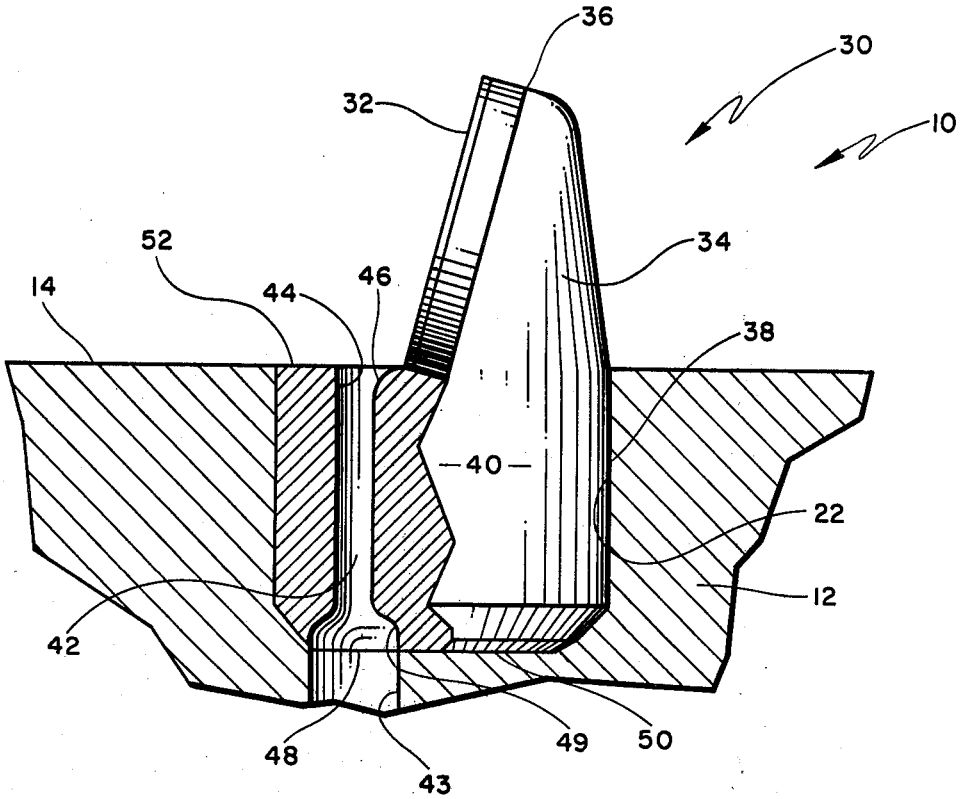

With particular reference to FIG. 2, the stud 30 of the preferred embodiment is hydraulically pressed into an interference fit hole 22 formed in bit body 12. A generally cylindrical rod chucked into an arbor of a hydraulic press (not shown) is seated on datum surface 52 of stud 30. The flat surface 52 provides a seat for the bottom of the pressing rod chucked into the hydraulic press. The insert 30 then can be accurately driven into the interference fit hole 22 the full grip length 40 of the stud 30. Thus botom portion 38 is fully seated within hole 22; the base 50 securely seated to the bottom of hole 22. The alignment of the passageway 42 with the hydraulic passageway 43 within bit body 12 is determined by the orientation of the cutting face 32 with respect to the face 14 of bit body 12. These two passageways 42 and 43, of course, are carefully aligned prior to the pressing operation of the stud within face 14 of drag bit 12.

Figure 3:
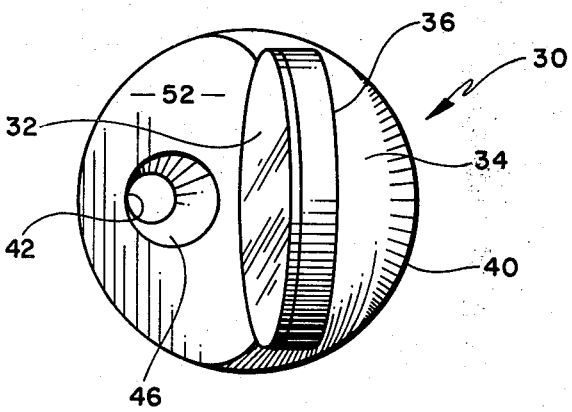

FIG. 3 illustrates the datum surface 52, the area of surface 52 being more than sufficient to support the end of the stud insert tool to accurately drive the stud 30 within hole 22. In addition, the exit 44 of passageway 42 is clearly indicated with flare 46 providing the means to diffuse mud exiting passageway 42 over, across and around the synthetic diamond composite 32.

Figure 4:
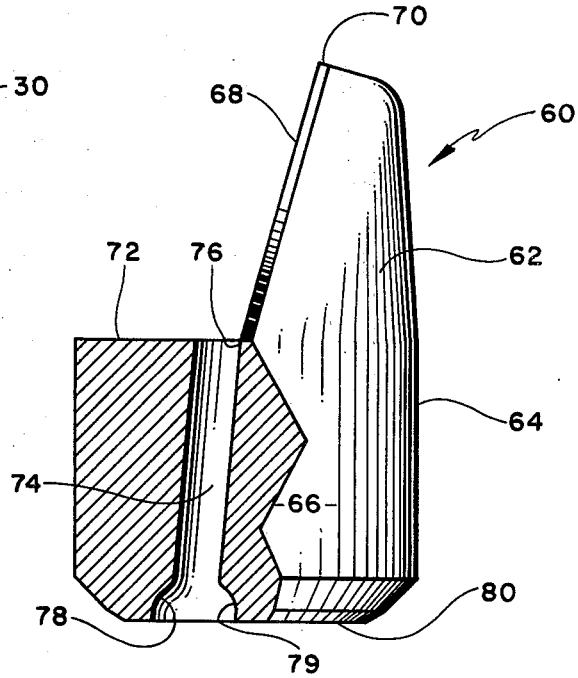

The alternative embodiment illustrated in FIG. 4 is comprised of a synthetic diamond stud, generally designated as 60, with a thin synthetic diamond polycrystalline layer 68 bonded at joint 70 to extended tungsten carbide stud portion 62. Bottom portion 64 of stud 60 forms an inner passageway 74 that is angled slighty with respect to the axis of the stud body. Passageway 74 has an inlet 78 that is widened at section 79 to match the hydraulic passage drilled in the drag bit body (not shown). The opposite end 76 exits very close to synthetic diamond layer 68. The slight angle of the passageway more readily directs fluid directly on the synthetic layer 68 to pass mud over and around the cutting face of the alternative stud 60. A datum surface 72 is defined between base 80 and extended potion 62, the surface being transverse to the axis of the stud. Grip length 66 of lower portion 64 ends at surface 72. Again, surface 72 provides a means to insert the stud 60 within the face of a drag bit.

It would be obvious to provide a passageway within a stud insert of the type other than one that has a synthetic diamond cutting face. Any stand-off stud fabricated from a material, such as, tungsten carbide may have a passageway to cool the cutting surface of the stud as it is working in a borehole.

In addition, it would be obvious to move the cutting surface away from the center line of a stud so that the passageway is aligned with the center line of the stud. With this design, it would not make any difference what the orientation of the cutting face of the stud is, the passageway within the drag bit and the passageway defined by the stud would always be aligned. This feature would eliminate the necessity to align passageways which are not concentric with the axis of the stud.

It will of course be realized that various modifications can be made in the design and operation of the present invention without departing from the spirit thereof. Thus, while the principal preferred construction and mode of operation of the invention have been explained in what is now considered to represent its best embodiments has been illustrated and described, it should be understood that within the scope of the appended claims, the invention may be practiced otherwise than as specifically illustrated and described.

I claim:

1. A man-made synthetic diamond insert stud comprising:

a substantially cylindrical stud body having a first extended diamond faced cutter end and a second base end, a fluid passage having a first exit end and second entry end formed by said body of said stud, said fluid passage being substantially aligned with the axis of said body, said first exit end of said passage formed by said stud being substantially aligned and flared to diffuse fluid exiting said first exit end over and around said diamond face of said first extended diamond faced cutter end of said stud body.

* * * * *